United States Patent [19]

Adams

[11] Patent Number: 4,581,862

[45] Date of Patent: Apr. 15, 1986

[54] DRILLING EQUIPMENT TOWER RAISING MECHANISM

[76] Inventor: Richard S. Adams, P.O. Box 1936, Anna Maria, Fla. 33501

[21] Appl. No.: 639,108

[22] Filed: Aug. 9, 1984

[51] Int. Cl.[4] ..... E04H 12/34

[52] U.S. Cl. ..... 52/119; 52/115

[58] Field of Search ..... 52/114, 115, 116, 119; 182/63; 173/28, 42, 43

[56] References Cited

U.S. PATENT DOCUMENTS

| | | | |
|---|---|---|---|
| 2,595,307 | 5/1952 | Selberg | 52/119 X |
| 2,808,911 | 10/1957 | McLerran | 52/119 |
| 3,438,450 | 4/1969 | Failing | 173/28 X |
| 3,704,560 | 12/1972 | Ratcliff, Jr. | 52/114 X |
| 4,368,602 | 1/1983 | Manten . | |

FOREIGN PATENT DOCUMENTS

| | | | |
|---|---|---|---|
| 727844 | 2/1966 | Canada | 52/116 |
| 615008 | 5/1935 | Fed. Rep. of Germany | 173/43 |
| 1289495 | 2/1969 | Fed. Rep. of Germany | 173/28 |
| 2201134 | 7/1973 | Fed. Rep. of Germany | 173/43 |

*Primary Examiner*—Alfred C. Perham
*Assistant Examiner*—Jean M. LaKemper
*Attorney, Agent, or Firm*—Jesus Sanchelima

[57] ABSTRACT

A raising mechanism for drilling equipment towers mounted on a platform and having two pairs of linkage members, one shorter than the other one, each pair having its members connected on one end to each other and to the underside of the tower at spaced apart points. A cylinder is designed to vary the angle between the tower and the linkage members thereby causing the tower to move from a substantially horizontal position to a vertical position, or if desired, to a forward inclined position by the use of removable wedge elements.

6 Claims, 5 Drawing Figures

DRILLING EQUIPMENT TOWER RAISING MECHANISM

BACKGROUND OF THE INVENTION:

1. Field of the Invention.

The present invention relates to a mechanism for raising a tower from a horizontal to a vertical position, and more particularly to such mechanisms using hydraulic cylinders.

2. Description of the prior art.

Applicant believes that the closest reference corresponds to U.S. Pat. No. 4,368,602, issued to Heinrich Manten. However, it differs from the present invention because it requires slider 6 for leg 5, which is not required with the present invention.

Other patents describing the closest subject matter provide for a number of more or less complicated features that fail to solve the problem in an efficient and economical way. None of these patents suggest the novel features of the present invention.

SUMMARY OF THE INVENTION;

It is the main object of the present invention to provide a mechanism for raising an elongated structure or member from its horizontal position to a vertical or other inclined position with respect to a fixed base or platform.

It is another object of the present invention to provide such mechanism that will insure the mechanical integrity of the structure once it has been raised.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
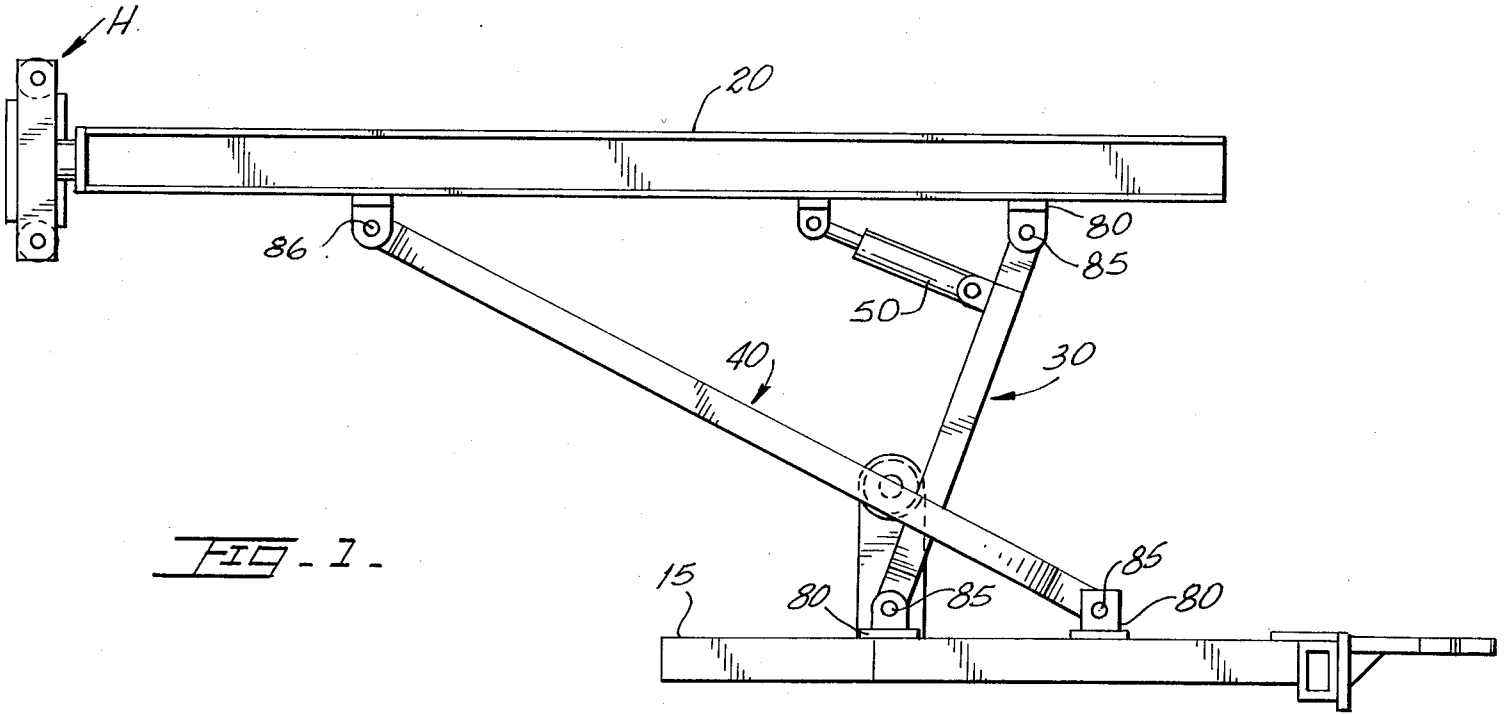
FIG. 1 represents a side view of the two sets of support links hingedly mounted to the platform and tower.
Figure 3:
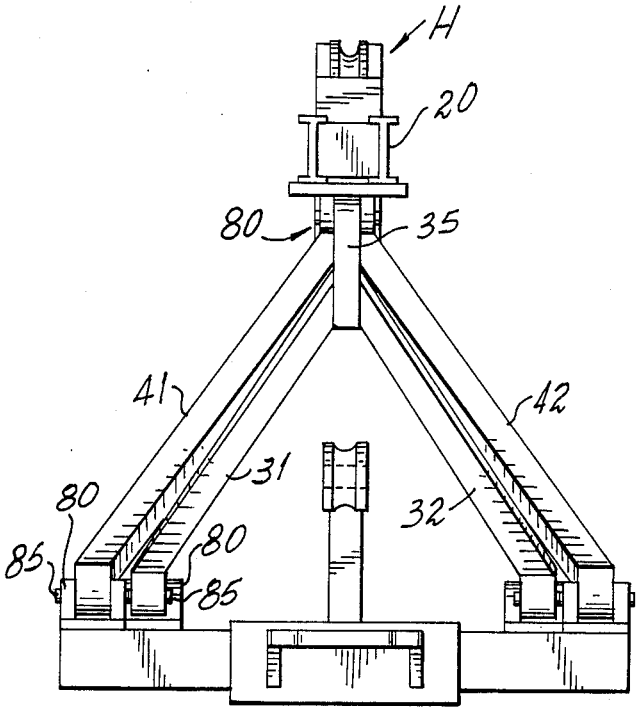
FIG. 3 illustrates the mechanism from the rear, as seen from the right side of FIG. 1.

Tower 20 is typically an elongated structure with its center of gravity around its middle section. Tower 20 has a base on the end where it rests.

From FIGS. 1 through 4 it can be observed that the present invention includes two pairs of linkage members that are hingedly mounted to a fixed platform 15 on one end and the other ends of said pairs being hingedly mounted to a tower 20. Tower 20 is commonly in vertical position when drilling a well and in horizontal position during transportation and storage. One of the pairs will be referenced to by the term short linkage pair 30, consisting of members 31 and 32. The other pair will be the long linkage pair 40, consisting of members 41 and 42. Short linkage pair 30 comprises members 31 and 32 in an inverted V-shape configuration baving its separated legs or ends pivotally mounted on platform 15 and the ends on the vertex being welded together in the preferred embodiment. Similarly, long linkage pair 40 comprises members 41 and 42 in an inverted V-shape configuration having its separated legs or ends pivotally mounted on platform 15 and the ends on the vertex being welded together in the preferred embodiment. Member 35 protrudes upwardly from the junctions of members 31-32 and 41-42 (not shown). The upper section of member 35 includes a bushing which is part of bushing assembling 80. The length of linkage pair 30 is smaller than linkage pair 40. A hydraulic cylinder 50 is mounted between one of the links of the small pair 30 and a suitable point on the underside of the tower 20.

Figure 2:
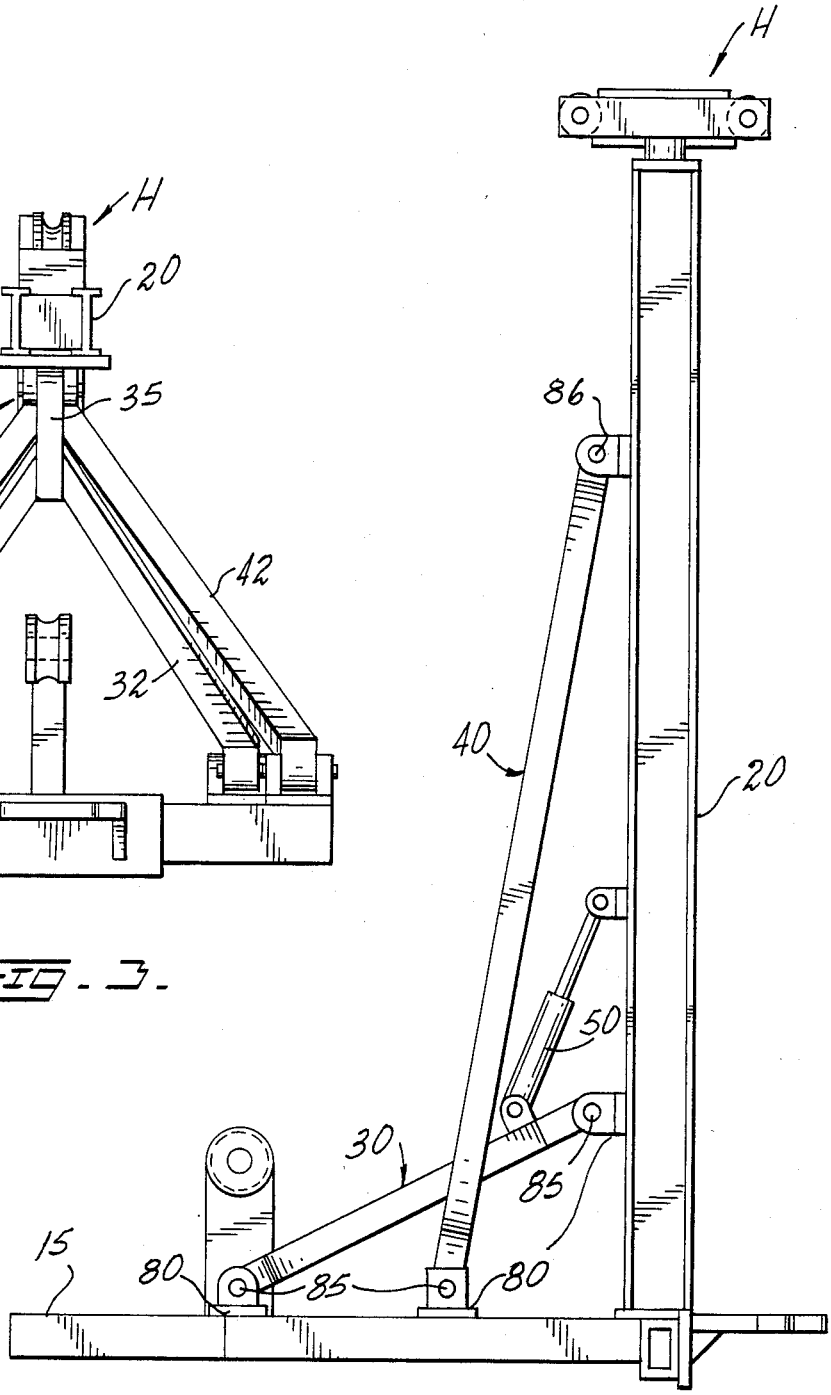
FIG. 2 shows the tower and support link sets in vertical position.
Figure 5:
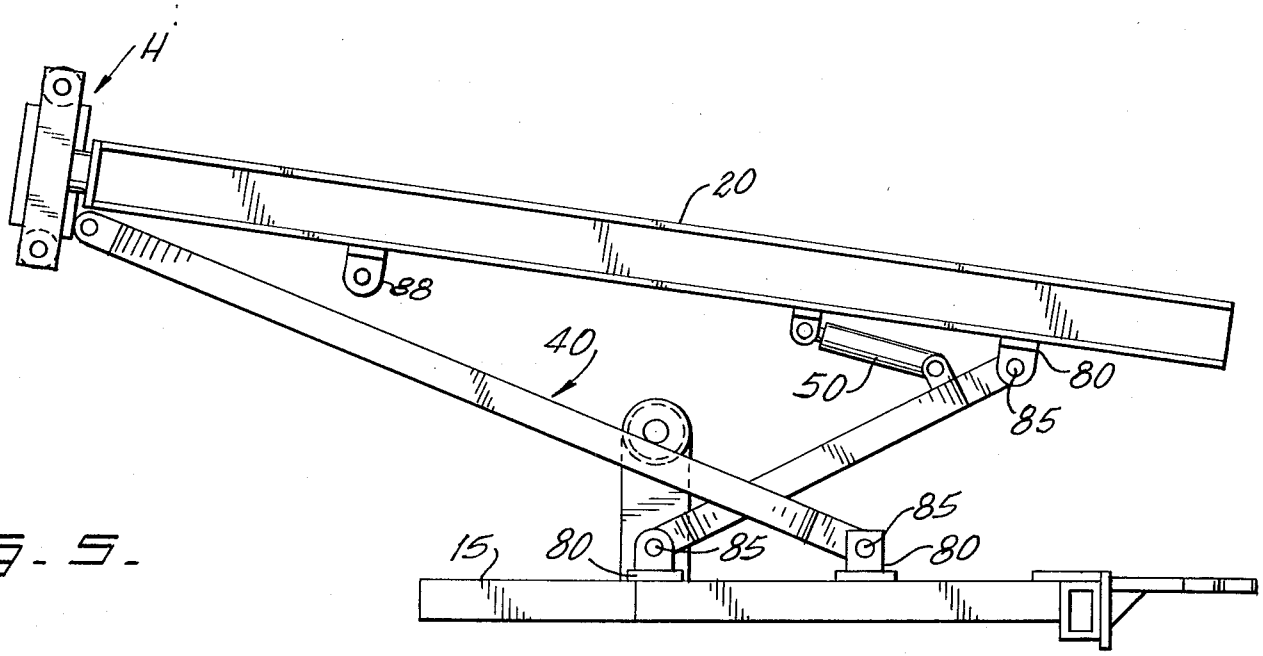
FIG. 5 shows the present invention, in the transportation position.

As shown in FIG. 2, tower 20 has been raised to a vertical position and cylinder 50 is in distension. Bushing assemblies 80 are used in conjunction with pins 85 to provide the hinge or pivoting function. Pin 86 which is hingedly connected to bushing assembly 88 on the underside of tower 20 may be taken out and substantial volumetric efficiency is achieved for transportation or storage. By taking out pin 86, tower 20 collapses or drops down closer to platform 15, as shown in FIG. 5.

Figure 4:
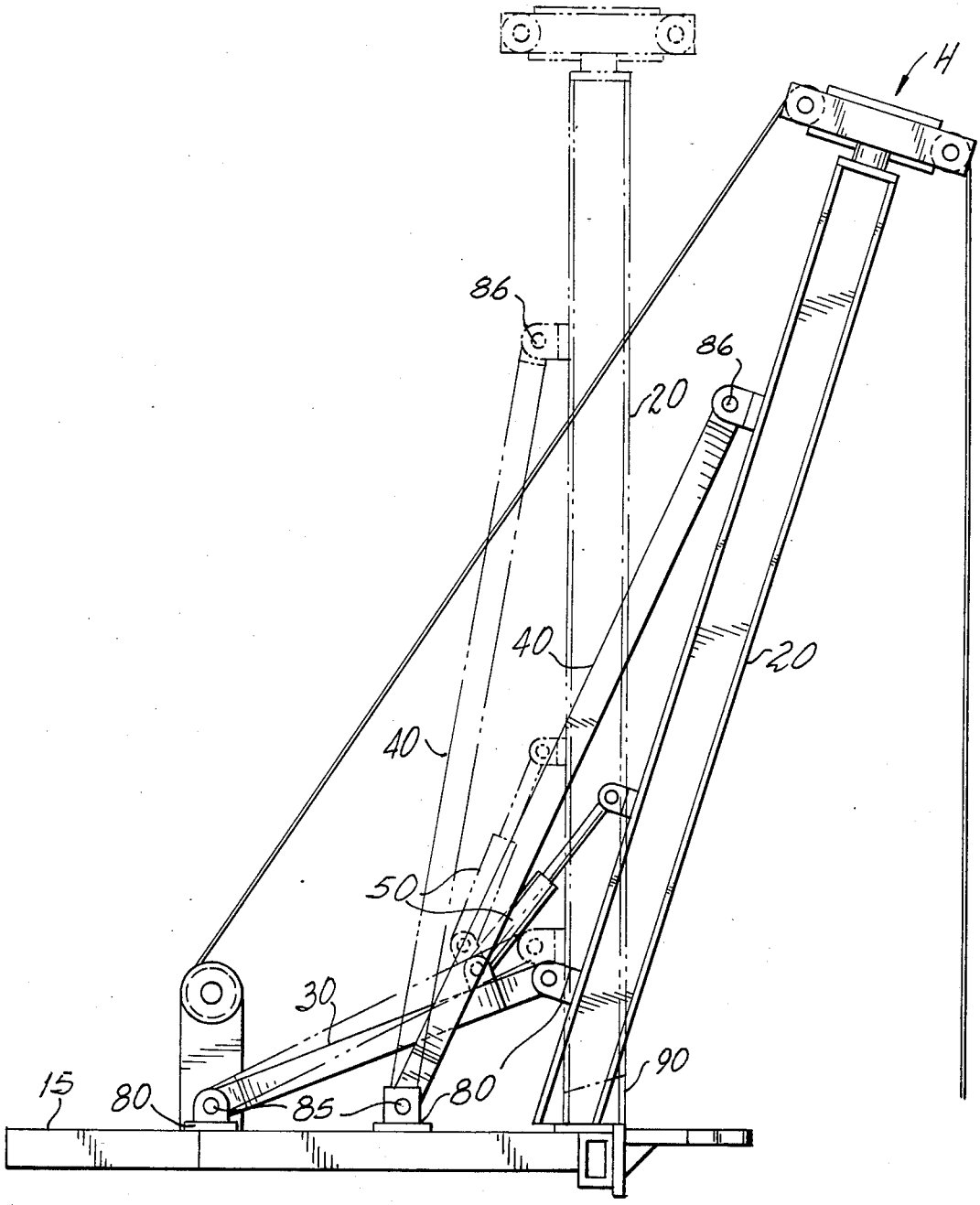
FIG. 4 is a representation of the mechanism in an inclined position, utilized a removable wedge to achieve the desired angle.

Since the present invention is directed, primarily, to well drilling, mining and other subsoil exploration activities, an improvement of this mechanism will include a hoist assembly H that will provide the capability of raising the lowering pumping equipment, pipes and casing elements into and out of wells. As shown in FIG. 4, a removable wedge 90 allows tower 20 to lean forward when removed. This will facilitate the use of the hoist assembly. An angle of approximately 15 degrees should be sufficient, but different angles may be preselected to provide more or less inclination.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A raising mechanism for a drilling equipment tower and said tower having a center of gravity substantially around its longitudinal middle, comprising:

a. a platform including a base on which said tower rests;

b. a first pair of fixed length linkage members, each linkage member having an upper and a lower end, pivotally mounted on said lower ends to said platform at spaced apart locations and said upper ends joined together and connected to a point on one side of said tower away from said center of gravity of said tower through first pivoting means;

c. a second pair of linkage members each linkage member having an upper and a lower end, and said second pair of linkage members being of shorter length than said first pair of linkage members, pivotally mounted on said lower ends to a location on said platform farther away from the location of the base of said tower when raised in vertical position than said first pair of linkage members and said upper ends of said second linkage members jointed together and connected to said tower through second pivoting means at a point substantially closer to the end of the tower that rests on said base; and d. hydraulic means for changing the angle defined by the axes of said tower and said second pair of linkage members.

2. The mechanism set forth in claim 1 further including:

e. a removable wedge member at said base of said tower and having a predetermined dimension so that said tower comes to rest at a predetermined angle with respect to the vertical position achieved when said wedge member is not removed.

3. The mechanism set forth in claim 2 wherein said first and second pivot means includes a plurality of bushings and pins.

4. The mechanism set forth in claim 3 wherein said first and second pairs of linkage members include a plurality of bushing assemblies which, in conjunction with a corresponding number of pins, provide said pivoting function.

5. The mechanism set forth in claim 4 wherein the pin of said first pivoting means is readily removable thereby allowing the collapse of said tower.

6. The mechanism set forth in claim 5 wherein all of said pins are removable thereby allowing the collapse of said tower.

* * * * *